US009748010B2

(12) United States Patent
Gay et al.

(10) Patent No.: US 9,748,010 B2
(45) Date of Patent: Aug. 29, 2017

(54) HANDLING AND CONFINEMENT HOOD, APPLICATION TO HANDLING HOLDERS OF SAMPLES OF NUCLEAR MATERIALS SUCH AS NUCLEAR FUELS

(71) Applicant: COMMISSARIAT A L'ENERGIE ATOMIQUE ET AUX ENERGIES ALTERNATIVES, Paris (FR)

(72) Inventors: Sebastien Gay, Serres (FR); Xavier Mognot, Aix-en-Provence (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 850 days.

(21) Appl. No.: 14/249,126

(22) Filed: Apr. 9, 2014

(65) Prior Publication Data

US 2014/0301521 A1 Oct. 9, 2014

(30) Foreign Application Priority Data

Apr. 9, 2013 (FR) ..... 13 53162

(51) Int. Cl.

| | |
|---|---|
| ***G21F 5/06*** | (2006.01) |
| ***G21F 7/005*** | (2006.01) |
| ***G21F 7/06*** | (2006.01) |
| *G21F 5/14* | (2006.01) |

(52) U.S. Cl.

CPC ..... *G21F 5/065* (2013.01); *G21F 7/005* (2013.01); *G21F 7/06* (2013.01); *G21F 5/14* (2013.01)

(58) Field of Classification Search

CPC ..... G21C 19/10; G21C 19/11; G21C 19/115; G21F 5/06; G21F 5/065; G21F 5/015; G21F 5/14; G21F 7/005; G21F 7/067

USPC ..... 376/202, 261, 262, 272, 171, 172; 294/906; 250/506.1, 507.1

See application file for complete search history.

(56) References Cited

U.S. PATENT DOCUMENTS 3,483,380 A 12/1969 Antonsen et al. ..... 376/272
4,577,112 A * 3/1986 Conche ..... G21F 5/005 250/506.1

FOREIGN PATENT DOCUMENTS

WO WO 2012/159119 11/2012

OTHER PUBLICATIONS

French Search Report and Written Opinion issued in French Patent Application No. FR 1353162, mailed Dec. 9, 2013.

* cited by examiner

*Primary Examiner* — Jack W Keith
*Assistant Examiner* — Sharon M Davis
(74) *Attorney, Agent, or Firm* — Norton Rose Fulbright US LLP

(57) ABSTRACT

The present invention concerns a hood for handling and confinement of at least two objects of slender shape, including an external enclosure and internal enclosures inside the external enclosure and at least one motor fixed above an internal enclosure and inside a barrel, the motor(s) being adapted to rotate the screw of the screw-nut mechanism of each internal enclosure and therefore the nut over a stroke A, and first and second mechanical control means, arranged in part above the cover of the external enclosure, respectively for manually guiding the internal enclosures in translation over a stroke A0 and manually pivoting the barrel in order to bring a holding member of one of the internal enclosures opposite the opening in the bottom of the external enclosure. Application to the handling and confinement of nuclear material sample holders.

13 Claims, 10 Drawing Sheets

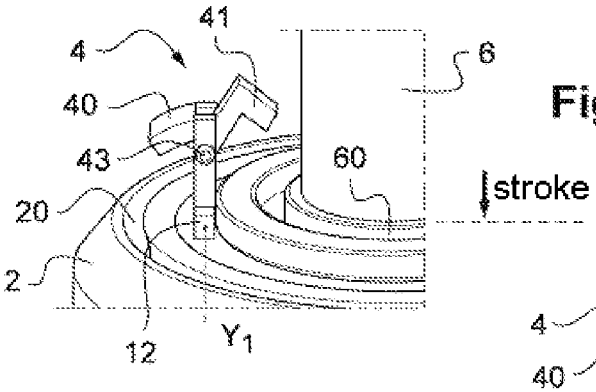
Fig.4F
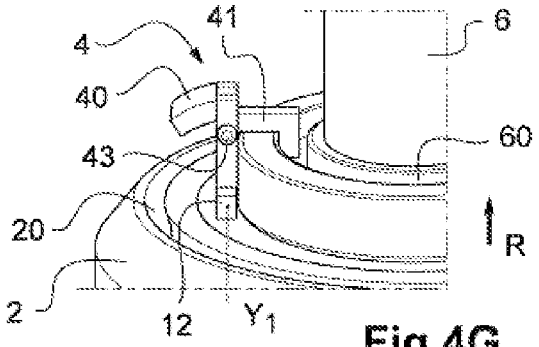
Fig.4G
Fig.4H
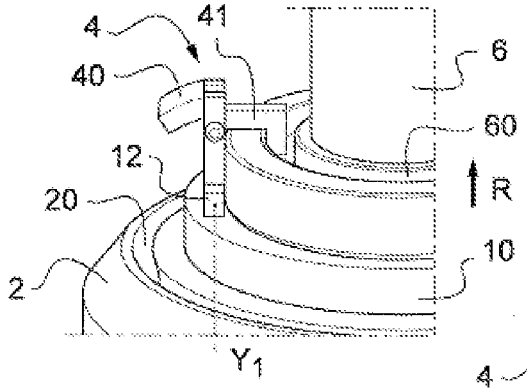
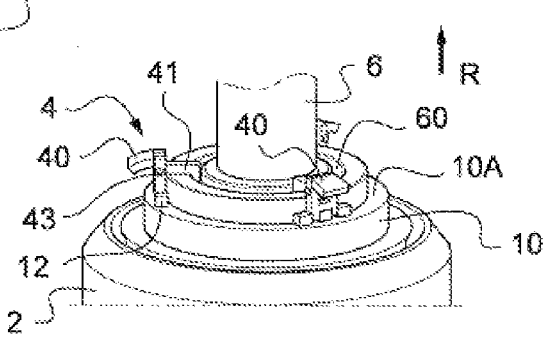
Fig.4I
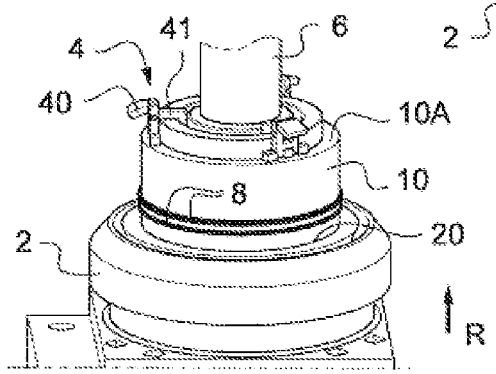
Fig.4J

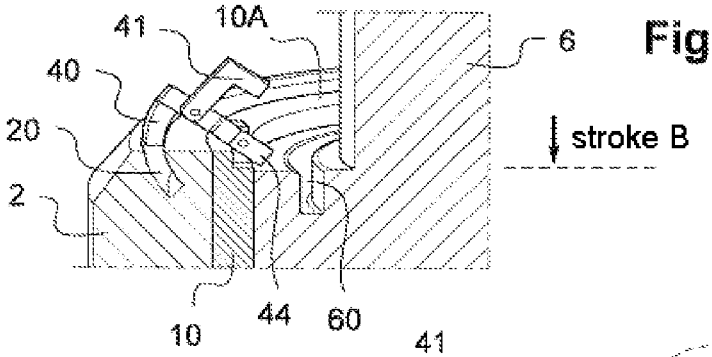
Fig.5F
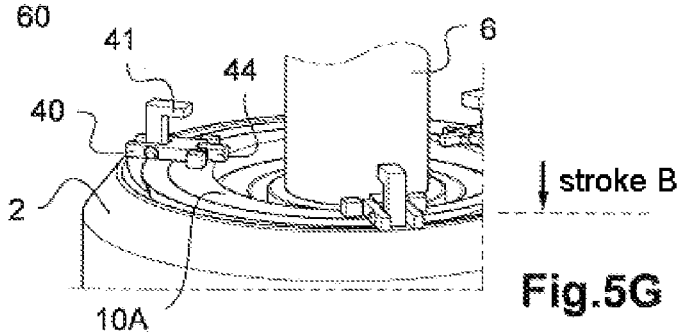
Fig.5G
Fig.5H
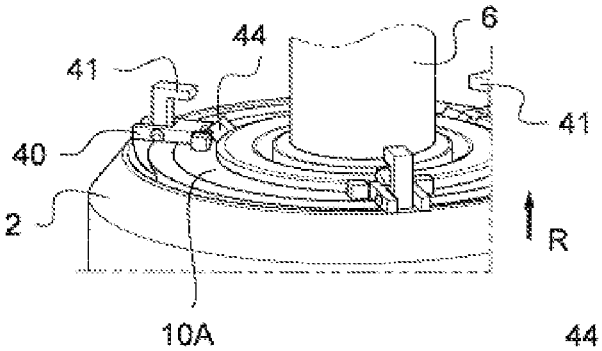
Fig.5I
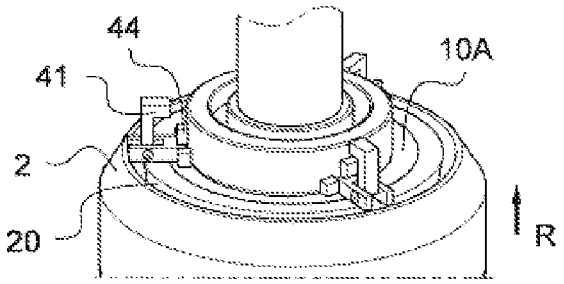
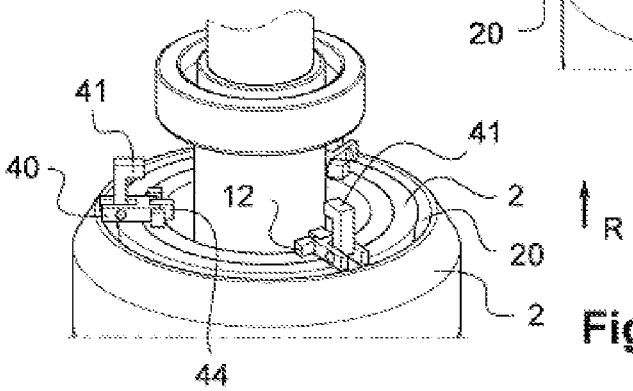
Fig.5J

HANDLING AND CONFINEMENT HOOD, APPLICATION TO HANDLING HOLDERS OF SAMPLES OF NUCLEAR MATERIALS SUCH AS NUCLEAR FUELS

FIELD OF THE INVENTION

The present invention concerns a new hood for handling and confinement of at least two objects of elongate shape.

The main target application of the invention is handling nuclear material sample-holders, in a research nuclear reactor so as to enable introduction and extraction of sample-holders without breaking the confinement with respect to the external atmosphere.

Although described hereinafter with reference to the main application, the invention applies equally to any application in which it is necessary to handle and to confine objects of elongate shape, in particular in environments imposing overall size and safety constraints.

For conciseness, throughout the present application, a sample-holder tube may be referred to as an "SH tube" and an instrumentation-holder tube as an "IH tube".

Throughout the present application, the terms "lower", "upper", "vertical", "rise", "descend", "under" and "over" are to be understood with reference to handling by the holding member from above the upper end of an object to be handled and confined in a hood. Accordingly, during handling and confinement allowing holding of an object of elongate shape and then its introduction into the hood, the holding member descends and then rises.

PRIOR ART

To test the behaviour of materials and fuels subjected to thermal, neutron and even chemical loads representative of full scale functioning in an industrial nuclear reactor, it is routine to use research reactors, indispensable research and development tools in the electronuclear industry.

These research nuclear reactors are also commonly referred to as irradiation reactors as they enable experiments to be carried out that irradiate samples of nuclear materials, such as nuclear fuels, in a pool near or within the reactor core.

In particular, the Jules Horowitz research reactor to be commissioned soon in France will make it possible to study the behaviour of nuclear fuels according to various irradiation scenarios.

To carry out irradiation experiments in irradiation reactors, irradiation devices are specifically designed as a function notably of their dedicated location in the core and/or nearby in an area of concentration of an irradiating flux.

The Jules Horowitz reactor includes an irradiation device that is specifically designed for the study of nuclear fuels and sheath materials of the rods containing the nuclear fuel.

For handling samples of nuclear materials in research nuclear reactors it is known to use as a sample-holder tube inside which is housed a sample such as a stack of nuclear fuel pellets.

To be more precise, a sample-holder tube (SH tube) includes a plurality of tubular portions with different sections including the enlarged section of the upper portion, referred to hereinafter as the holding head, by which the SH tube is held to handle it. The sample to be irradiated is arranged in a portion of the SH tube far away from the holding head, preferably at the opposite end to the latter, above all when the sample is a column of pellets of irradiating fuel. In the installed irradiation configuration within or near the core, the portion of the SH tube in which the sample is housed must be arranged in an area subjected to the neutron flux, under the conditions required by the irradiation experiment (T°, environment, etc.).

To measure physical parameters linked to the samples, the SH tube is introduced into a concentric blind tube referred to hereinafter as an instrumentation-holder tube tube), inside which are notably housed measurement sensors and a cooling system. An IH tube is secured to a part of the irradiation device.

Moreover, to meet safety requirements, it is necessary to provide a seal between the SH tube that constitutes the interior tube and the IH tube that constitutes the exterior tube in order to constitute a confinement barrier because the heat-exchange fluid of the cooling system circulating between the IH and SH tubes at a high pressure, typically of at least 160 bar, must not be able to escape into the irradiation reactor pool. In other words, in the installed irradiation configuration, it is necessary for the SH tube to be locked into and sealed in the IH tube.

Accordingly, before an irradiation experiment, the handling of an SH tube necessitates holding it with a holding member, lowering the holding member and the SH tube to introduce the latter into an IH tube, sealed mutual interlocking between the SH and IH tubes and raising of the holding member on its own.

Conversely, after an irradiation experiment, the handling of an SH tube accommodated in the IH tube necessitates lowering the holding member, holding the SH tube with the holding member, unlocking the SH tube from the IH tube and then raising the holding member and the SH tube.

Also, to meet safety requirements, holding the SH tube with the holding member must include locking of the holding force.

In the field of handling nuclear materials or radioactive substances, it is known to use holding systems (grapnels) including clamps with locking of the force of the clamps and to use hooks for locking/unlocking containers or casks containing either nuclear materials or containers themselves containing radioactive substances. The use of hooks as locking means is often preferred as they constitute a reliable solution that is simple to implement, notably with few mechanical parts.

In the patent application filed 4 Dec. 2012 under number U.S. Pat. No. 9,449,722, the applicant has proposed a new system for holding and locking/unlocking an interior tube in an exterior tube concentric with the interior tube, with locking/unlocking of the holding force that is reliable, simple to implement with a limited number of parts, and fast to use. This system is particularly suitable for holding an SH tube and for sealed locking/unlocking of the SH tube in an IH tube in an irradiation nuclear reactor. To be more precise, the new system consists essentially in one or more attachment devices that enable sealed locking/unlocking of the SH tube and the holding member before and after irradiation experiments in a radiation reactor as well as sealed locking/unlocking of the SH tube and the IH tube to carry out the experiment, with only movement in translation of a holding member over a stroke A or over a stroke B slightly greater than the stroke A.

To be able to hold an irradiated SH tube and to place a new SH tube in an IH tube using this new holding and locking/unlocking system without disconnecting electrical power supplies and fluid supplies at the same time as ensuring the continuity of the required confinement barriers, the inventors were then confronted with the necessity of finding a hood that incorporates means for movement in translation of the holding member of said system as well as means for confinement of the SH tubes and that can be used reliably underwater in a reactor pool.

Various sealed hoods for replacing irradiated equipment and transporting that equipment to an offloading unit where it can receive appropriate treatment or repairs have already been used in a nuclear environment.

There may be cited here patent application U.S. Pat. No. 4,577,112 which discloses a mobile confinement enclosure for the replacement and transportation of contaminated parts, with a sealed armoured body inside which is disposed a barrel with three cylindrical cells respectively adapted to receive a new part, a contaminated part and an observation or inspection instrument or another head for holding a plug providing access to the part to be evacuated or an intervention tool. This mobile enclosure further includes manual mechanical means for pivoting the barrel inside the body to bring each of the cells in turn opposite an opening of the same diameter in the body, a holding head slidably mounted in each cell by means of a rack rod, means for manual movement of the head arranged externally of the armoured body and enabling movement between a rear stowage position of the parts and a forward intervention position in which the holding head penetrates into said opening.

The mobile enclosure disclosed in this application U.S. Pat. No. 4,577,112 has the advantage of reliable replacement of contaminated parts by new parts without breaking the confinement.

However, such a mobile enclosure does not enable the holding and confinement of objects of slender shape, i.e. of very great length compared to the other dimensions, such as an SH tube, using a system according to the application U.S. Pat. No. 9,449,722, within a small overall size, for sealed use underwater, in particular underwater in a reactor pool, and with a high rate of working, for the following reasons.

The grapple used in the mobile enclosure according to the aforementioned application U.S. Pat. No. 4,577,112 slides on the outside of the armoured body and is sealed by a metal bellows. In the case of objects of slender shape, such as SH tubes, the strokes needed to hold them and confine them in a hood that is required to be of small overall size do not make it possible to envisage providing a seal by means of a metal bellows because of its necessary compression clearance. Accordingly, providing a seal over a stroke equal to the length of an SH tube, i.e. of the order of 3.5 m, using a metal bellows with the usual compression factor of the order of 10% of its length would necessarily amount to creating an enclosure in accordance with the aforementioned application U.S. Pat. No. 4,577,112 having a height of 35 m, which is incompatible with a requirement for small overall size.

Moreover, actuation of the holding member of the system according to the application U.S. Pat. No. 9,449,722 necessitates precise long-term control of the strokes A and B that must be effected. The holding member provided in the mobile enclosure in accordance with the aforementioned application U.S. Pat. No. 4,577,112 is a standard grapple and the means for moving it comprise a rack rod, which cannot provide this precise long-term control.

Finally, a metal sealing bellows in the mobile enclosure in accordance with the aforementioned application U.S. Pat. No. 4,577,112 fatigues and breaks very quickly and therefore has a very limited service life, with the corollary of complicated maintenance. This is therefore prejudicial to a high rate of working for replacing irradiated SH tubes with new SH tubes.

Thus there exists a requirement to improve the hoods for handling and confining objects of slender shape, notably with a view to enabling holding thereof with a system according to the patent application U.S. Pat. No. 9,449,722, within a small overall size, for sealed underwater use, in particular underwater in a reactor pool, and with a high rate of working.

SUMMARY OF THE INVENTION

The invention aims to address some or all of these requirements and in one aspect consists in a hood for confinement and handling of at least two objects of slender shape, including:

- an external first enclosure extending along a longitudinal axis X', including a cover, a bottom provided with an opening and a valve for blocking the opening and thereby sealing the external enclosure;
- a second enclosure forming a barrel, extending along the axis X' and guided in rotation about the axis X' inside the external enclosure;
- at least one internal third enclosure and one internal fourth enclosure each extending along a longitudinal axis X1, X2 parallel to the axis X' and each adapted to accommodate an object of elongate shape, the at least two internal enclosures being fastened to each other and guided in translation in the barrel over a stroke A0;

each internal enclosure including within it:

- a holding member adapted to pick up an object of elongate shape;
- a screw-nut mechanism consisting of a lead screw guided in rotation about the axis X1, X2 and a nut around the screw and to which the holding member is fastened, the mechanism being adapted to guide the latter in translation in the internal enclosure over a stroke A greater than the stroke A0;
- a bottom including an opening opposite the holding member to allow an object picked up thereby to pass through;

the hood further including:

- at least one motor fixed above an internal enclosure and inside the barrel, the motor(s) being adapted to rotate the screw of the screw-nut mechanism of each internal enclosure and therefore the nut over the stroke A;
- mechanical control means arranged in part above the cover of the external enclosure for manually guiding the internal enclosures in translation over the stroke A0;
- mechanical control means arranged in part above the cover of the external enclosure for manually pivoting the barrel in order to bring a holding member of one of the internal enclosures opposite the opening in the bottom of the external enclosure.

In other words, the invention essentially consists in a handling and confinement hood which:

- allows movement in translation of the holding member for an SH tube and its precise control over a stroke A or a slightly greater stroke B (B equal to A+A0), within a small overall size thanks on the one hand to the motor(s) and screw/nut mechanism(s) used as actuators of the holding member and on the other hand to the means for mechanical translation of the internal enclosures from the outside,
- allows sealed underwater use because of the sealed external enclosure and the independence of the internal enclosures respectively dedicated to the confinement of an irradiated SH tube and a new SH tube, and
- allows a high rate of working to be achieved for changing an irradiated SH tube for a new SH tube, notably because of the integrated barrel.

The hood in accordance with the invention is particularly advantageous because it is simple to produce, reliable and quick to use.

With a system according to the patent application U.S. Pat. No. 9,449,722, it allows reliable blind handling of material samples, i.e. in a configuration in which it is not possible to verify visually or by any other technological means, such as a video camera, the locked or non-locked state of the elements. The motor(s) and screw/nut mechanism(s) of each internal enclosure enable control of the stroke A achieved or not by the holding member toward and in the SH tube. The means for manually guiding the internal enclosures in translation over the stroke A0 allow accurate control of the stroke B, equal to A+A0.

In accordance with one advantageous embodiment, the hood further includes an internal fifth enclosure also extending along a longitudinal axis X3 parallel to the axis X' and adapted to accommodate an object of elongate shape, the three internal enclosures fastened to one another being distributed at 120° to one another inside the barrel. Thus an additional housing is obtained for an object to be handled and confined in the hood, such as an SH tube.

In accordance with an advantageous alternative embodiment, the valve for blocking the opening in the bottom of the external enclosure is a guillotine valve. With such a valve the overall size of the hood is reduced.

In accordance with an advantageous embodiment, the hood further includes a metal bellows fixed under each opening of an internal enclosure to provide the seal between the latter and the opening of the external enclosure on translation of the internal enclosures in the barrel. In other words this bellows provides the seal between the opening in the bottom of the external enclosure and the opening in the bottom of an internal enclosure upon downward movement of the latter.

In order to provide the seal between the barrel and the external enclosure, in particular when handling SH tubes underwater in a reactor pool, the hood preferably includes at least two O-rings each accommodated at least partly in a respective peripheral groove at the top and at the bottom of the external wall of the barrel.

In accordance with one advantageous embodiment, there is provided a motor fixed above each internal enclosure and inside the barrel, the motor being adapted to rotate the screw of the screw-nut mechanism of said internal enclosure and therefore the nut over the stroke A. The motor(s) are preferably electric motor(s).

In accordance with an advantageous feature, the holding member is mounted on the nut of the screw-nut mechanism by means of a plate guided against the internal wall of the internal enclosure by at least two lugs projecting from the plate and forming centring devices. This achieves perfect guidance in translation of the holding member inside the internal enclosure with no risk of jamming.

In accordance with one advantageous embodiment, the mechanical control means for manually guiding the internal enclosures in translation over the stroke A0 include a screw-nut mechanism consisting of a lead screw on a portion of a rod guided in rotation about the axis X' and passing through the cover and a nut around the screw and to which the internal enclosures are fastened.

Accordingly, manual rotation of the rod from outside the hood enables the internal enclosures inside the barrel to be moved downward in translation. This is advantageous because this mechanical control is simple to effect and reliable. In particular, when a very short stroke A0 compared to the stroke A effected by a motor actuating the screw-nut mechanism inside the internal enclosure is required, the small and reproducible rotation of the rod ensures precise long-term control of the stroke A0. This mechanical control by rotation of the rod is advantageous in an underwater environment in a nuclear reactor pool in which handling is effected blind or at least cannot be viewed precisely, safely and reliably. In fact, in such an environment there are no reliable visual verification means and having precise control of the stroke A0 from the outside therefore enables good execution of the latter verification.

This ensures effective unlocking of an SH tube from the holding member when using the holding and locking/unlocking system according to the patent application U.S. Pat. No. 9,449,722 the content whereof is entirely included in the present application.

To produce the stroke A0, a natural solution for a person skilled in the art would have been to use the same motor and screw/nut actuator mechanism inside an internal enclosure. In fact, this solution proves impractical. Indeed, implementing it would lead to having additionally to install in the hood according to the invention at least three electrical position sensors to detect the start and end of the strokes A and A0. This proves impossible because of the lack of space available in the hood, which is required to be compact, and because of the additional difficulty there would be in changing these sensor(s) in the event of failure.

In accordance with one embodiment, the mechanical control means for manually pivoting the barrel include a gear mechanism consisting of a gear on a portion of a rod guided in rotation parallel to the axis X' and passing through the cover and a toothed ring meshing internally with the gear and to which the barrel is fastened. In this way a so-called turntable mechanism is produced that is very compact and therefore enables a small overall size of the hood to be preserved.

The holding member advantageously includes a holding head adapted to be accommodated in an interior tube constituting an object of elongate shape to be picked up, the interior tube itself being adapted to be inserted in an exterior tube. Thus it is possible to use directly handling and locking/unlocking by the holding system from the patent application U.S. Pat. No. 9,449,722, the content of which is fully contained in this application.

The invention also consists in use of the hood that has just been described for the handling and confinement of the interior tube constituting a material sample holder tube, the exterior tube constituting a measurement instrumentation holder.

In this use, the sample-holder tube is intended to house a sample of nuclear materials, such as nuclear fuels, in a measurement instrumentation holder tube intended to house at least measurement sensors and where applicable a cooling system.

DETAILED DESCRIPTION

Other advantages and features of the invention will emerge more clearly on reading the detailed description of embodiments of the invention given by way of nonlimiting illustration with reference to the following figures, in which:

FIG. 1 is a diagrammatic view in the installed irradiation configuration of a sample-holder (SH) tube in an instrumentation-holder (IH) tube in a research nuclear reactor;

FIG. 2 is a diagrammatic partly exploded view of an attachment device connected to an interior tube in accordance with the patent application U.S. Pat. No. 9,449,722;

FIG. 3 is a diagrammatic view of the interior of the interior tube showing a detail of the attachment device in accordance with the patent application U.S. Pat. No. 9,449,722 with the optional return means for its locking hook;

FIGS. 4A to 4J are perspective sectional views showing the various steps of holding the interior tube by the holding member simultaneously with unlocking between the interior and exterior tubes in accordance with the patent application U.S. Pat. No. 9,449,722;

FIGS. 5A to 5J are perspective sectional views showing the various steps of releasing the interior tube of the holding member simultaneously with the locking between interior and exterior tubes in accordance with the patent application U.S. Pat. No. 9,449,722;

Figure 1:
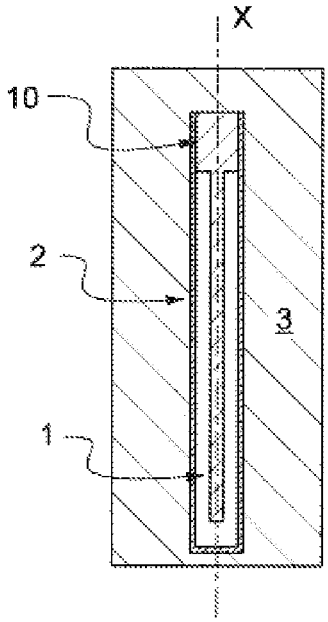

There is shown in FIG. 1 an interior tube 1, 10 with longitudinal axis X constituting a sample-holder tube intended to accommodate a sample of nuclear materials, such as nuclear fuels, such that it must be locked in an exterior tube 2 constituting a measurement instrumentation holder intended to house measurement sensors and a cooling system for the purposes of irradiation experiments in a water pool 3 of a research nuclear reactor.

To be more precise, the interior tube 1 includes a tubular lower portion in which is housed a sample of nuclear materials, such as a stack of nuclear fuel pellets, and a tubular upper portion 10 by which it is held by a holding member 6.

Prior to any irradiation experiment, it must be possible for the interior tube 1 to be brought up to and introduced into the exterior tube 2 by lowering a holding member and then locked to the exterior tube 2 and for the holding member to be released from the interior tube 1 in order to be raised.

After one or more irradiation experiments, it must be possible for the interior tube 1 to be unlocked from the interior of the exterior tube 2 in which it is housed and for the holding member to grasp the interior tube 1 that has been unlocked and rise with the latter to extract it from the pool 3.

In accordance with the patent application U.S. Pat. No. 9,449,722, there is provided a new holding and locking/unlocking system of which the embodiment from FIGS. 2 to 5I is reproduced here. The system with at least one attachment device 4 is provided on the one hand for the releasing of the interior tube 1 by the holding member 6 and by the same movement of the holding member 6 the sealed locking of the interior tube 1 to the exterior tube 2 and on the other hand for the unlocking of the interior tube 1 housed in the exterior tube 2 and by the same movement of the holding member 6 the holding of the interior tube 1 by the holding member 6.

The exterior tube 2 and the holding member 6 include respective grooves 20, 60. The interior tube 1, 10 includes at least one notch 11 at its upper end 10*a*. The holding head of the holding member 6 has an outside diameter matching the inside diameter of the interior tube 1.

Figure 2:
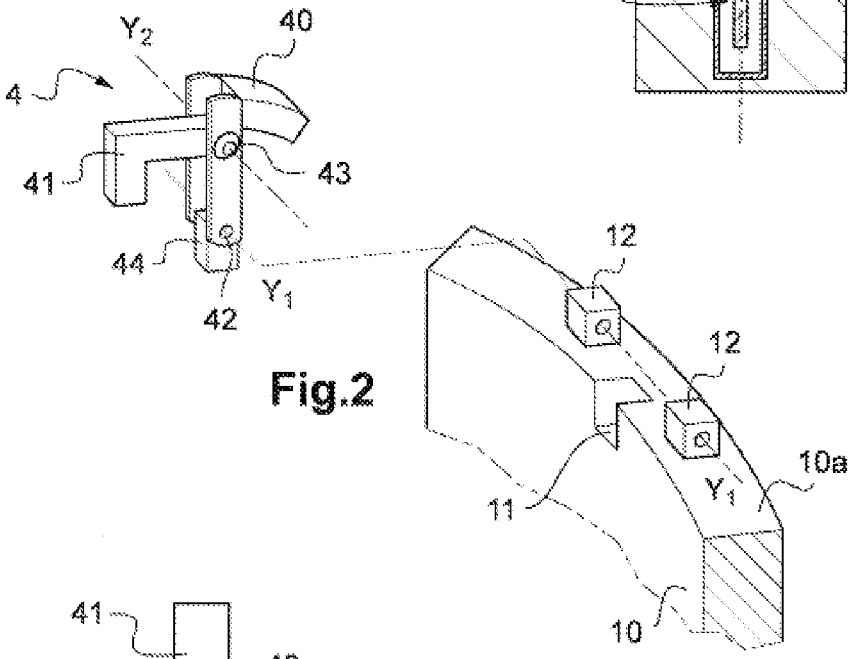
Figure 3:
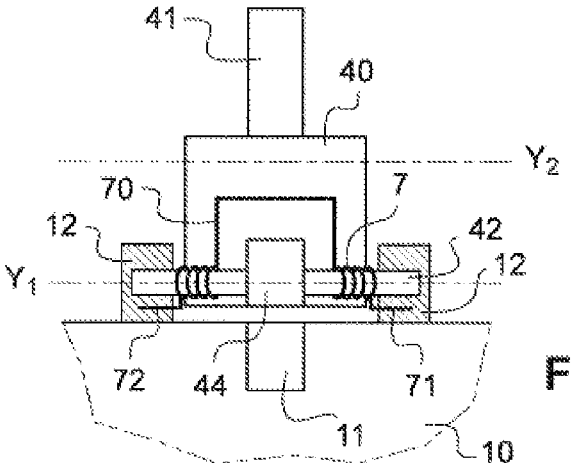

An attachment device 4 in accordance with the patent application U.S. Pat. No. 9,449,722 is connected to the upper end 10*a* of the interior tube 10. The attachment device consists of a double hook 40, 41 of which one hook 40 is mounted to pivot about a pin 42, Y1 orthogonal to the longitudinal axis X of the interior tube. As shown in FIGS. 2 and 3, this pin 42 may be mounted in two spaced-apart lugs 12 themselves fixed to the upper end 10*a* of the interior tube 1, 10. The two lugs may be made in one piece with the interior tube 1, 10.

To be more precise, the attachment device 4 firstly includes a locking hook 40 mounted to pivot about the pin 42, Y1 orthogonal to the longitudinal axis X of the interior tube, between a locking position in which it is housed in the groove 20 of the exterior tube 2 to lock the latter to the interior tube 1 and an unlocking position in which it is away from said groove 20.

The attachment device 4 also includes a holding hook 41 mounted to pivot on the locking hook about a pin 43, Y2 also orthogonal to the longitudinal axis X of the interior tube 1 between a holding position in which it is housed in the groove 60 of the holding head 6 to hold the interior tube and at least one release position in which it is away from said groove 60.

The attachment device 4 also includes an actuating lever 44 mounted to pivot about the axis Y1 of the locking hook 40 between a first neutral position in which it is away from the notch and does not project inside the interior tube 1 and a second neutral position in which it is housed in the notch 11, passing through an actuation position in which it projects inside the interior tube 1. The actuating lever 44 is connected to the locking hook 40 to rotate with it between its actuation position and its second neutral position and free to rotate relative to the locking hook 40 between its first and second neutral positions, as explained hereinafter with reference to FIGS. 4A to 4I. As shown in all the figures, the actuating lever may consist in a simple lug 44 in line with the locking hook 40.

Figure 6A:
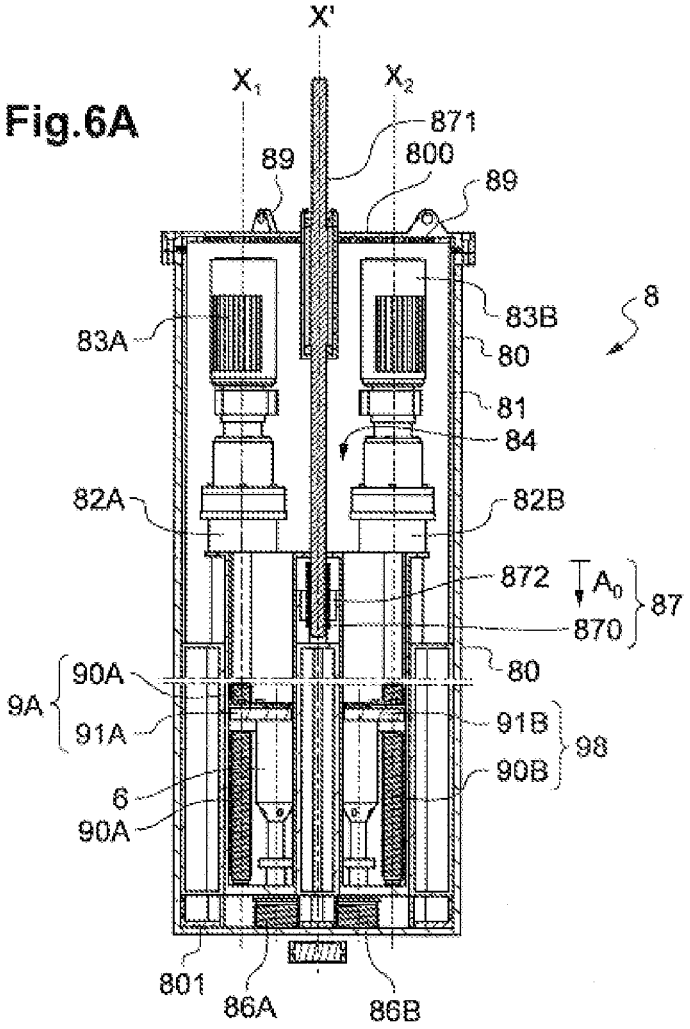
FIG. 6A is a view of the hood from FIG. 6 in longitudinal section taken along the line A-A.
Figure 6:
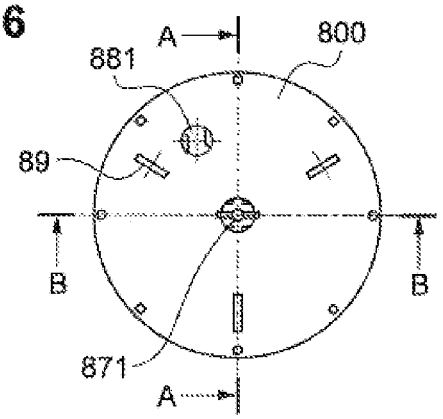
FIG. 6 is a plan view of the handling and confinement hood in accordance with the invention.
Figure 6B:
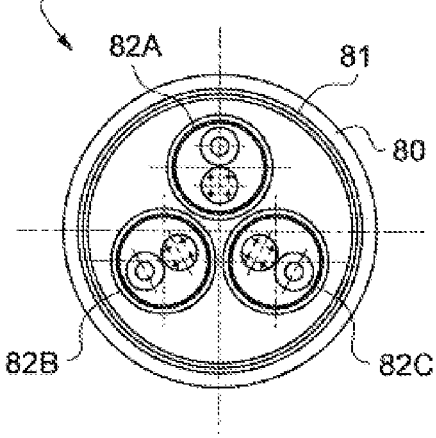
FIG. 6B is a view of the hood from FIG. 6 in cross section taken along the line B-B.
Figure 6E:
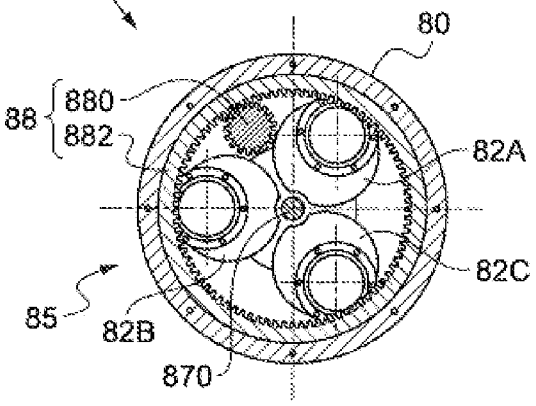
FIGS. 6E, 6F and 6H are views of the hood from FIG. 6 in cross section taken along the lines E-E, F-F and H-H, respectively.
Figure 6F:
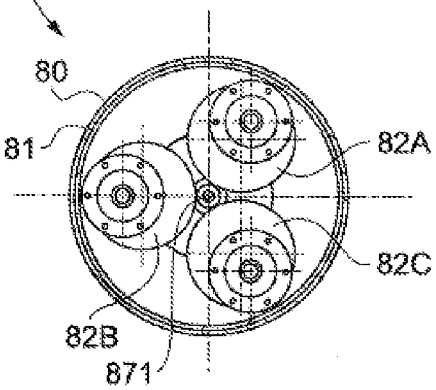
Figure 6H:
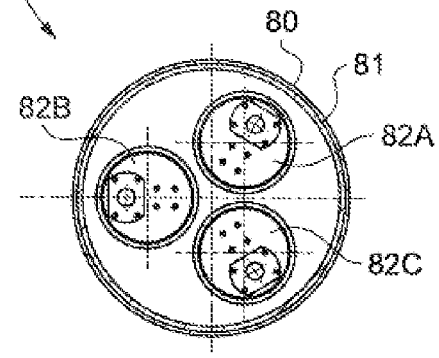
Figure 7:
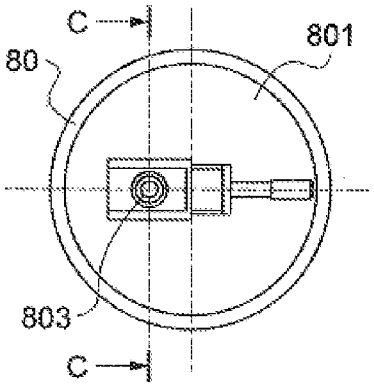
FIG. 7 is a bottom view of the handling and confinement hood in accordance with the invention.
Figure 6C:
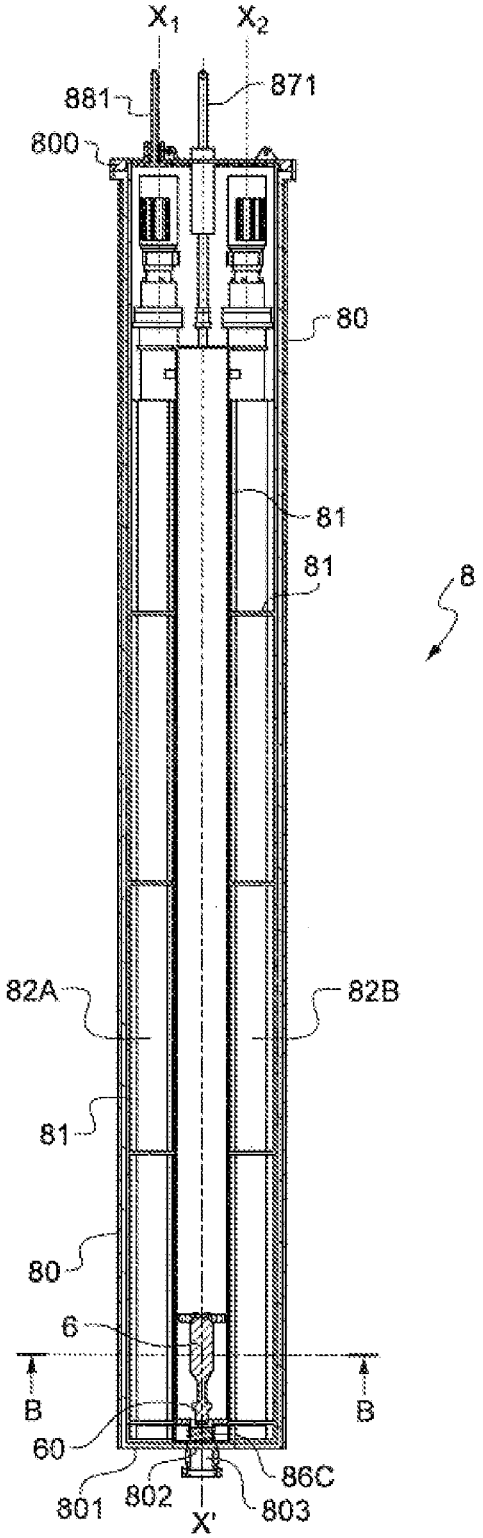
FIGS. 6C and 6D are views of the hood from FIG. 6 in longitudinal section taken along the lines C-C and D-D, respectively.
Figure 6D:
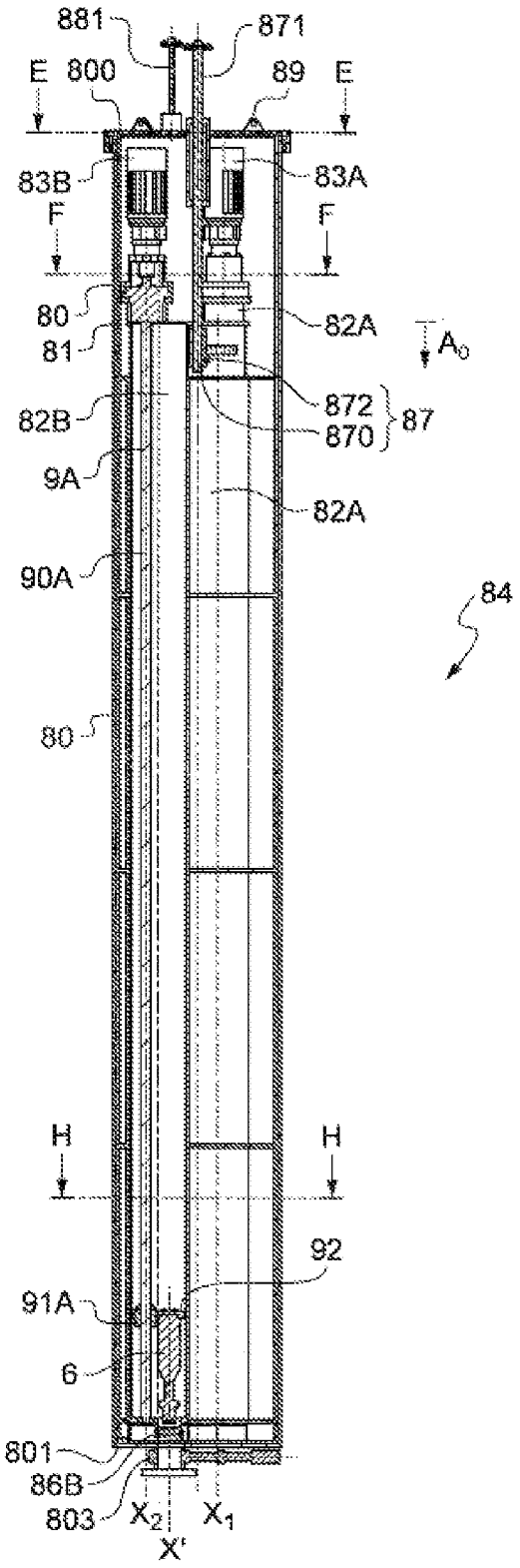

The holding and locking/unlocking system in accordance with the patent application U.S. Pat. No. 9,449,722 finally includes elastic return means 5 for returning the holding hook 41 from a release position toward its holding position. As shown in FIG. 6, the elastic return means may advantageously consist in a torsion spring 5 mounted around the pivot pin 43, Y2 of the holding hook 41 with its two end turns fixed and a central bearing turn 50 conformed to bear against the holding hook 41.

The system in accordance with the patent application U.S. Pat. No. 9,449,722 may further include additional elastic return means 7 for returning the locking hook 40 from its unlocking position toward its locking position.

In the embodiment shown in FIG. 4A to 5I, the system in accordance with the U.S. Pat. No. 9,449,722 includes three attachment devices 4 like that described, arranged at 120° from one another relative to the longitudinal axis (X) of the interior tube 2. Such an embodiment is advantageous because it enables an isostatic distribution of the holding and locking forces. In the same embodiment, the respective grooves 20, 60 of the exterior tube 2 and the holding member 6 are each produced around all the periphery of the latter.

It is specified here that the arrows D indicate descent of the holding member 6 while the arrows R indicate rising of the holding member 6.

It is also specified that the stroke A designates the stroke achieved by the holding member 6 at the end of its descent when holding the interior tube 1 locked to the exterior tube 2 (FIGS. 4A to 4J).

For its part, the stroke B designates the stroke achieved by the holding member 6 at the end of its descent on releasing the interior tube 1 and locking the latter to the exterior tube 2 (FIGS. 5A to 5J).

There will now be described the kinematics of the holding of the interior tube 1 by the holding member 6 and, in the same movement of the holding member 6, the unlocking of the interior tube 1 and the exterior tube 2 that the configuration of the system in accordance with the invention allows.

Figure 4A:
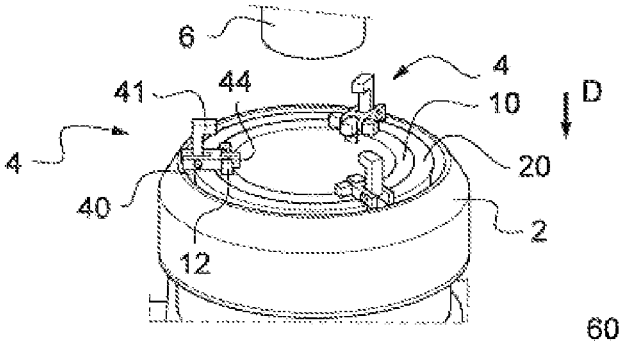
Figure 4B:
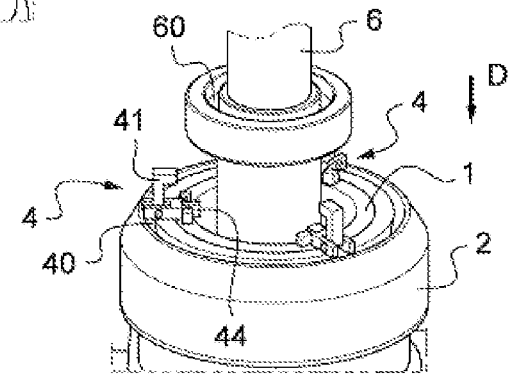

When the interior tube 1 and the exterior tube 2 are locked together by the locking hook 40 and it is required to extract the interior tube 1, the holding member is lowered (FIGS. 4A and 4B).

Figure 4C:
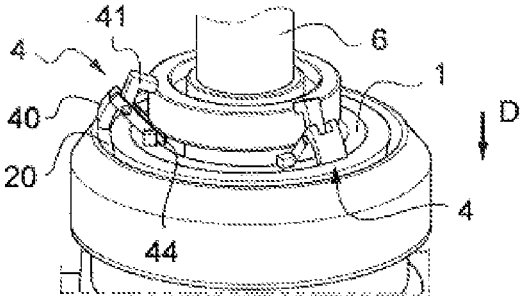
Figure 4D:
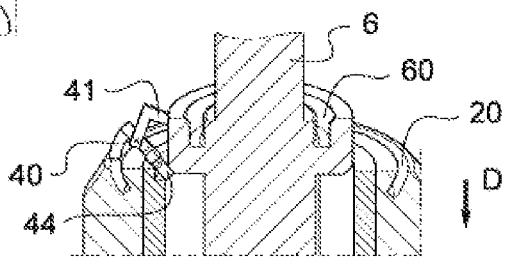

As it descends, when the holding member 6 comes into abutting engagement against the actuating lever 44, the latter pivots and the locking hook 40, rotationally connected to the lever 44, simultaneously pivots about the axis Y1 toward the interior of the tube 1, 2 from its locking position towards its unlocking position (FIG. 4C-4D). Because of its contact with the exterior surface of the holding head, the holding hook 41 pivots through an angle of a few degrees towards the exterior of the tubes.

Figure 4E:
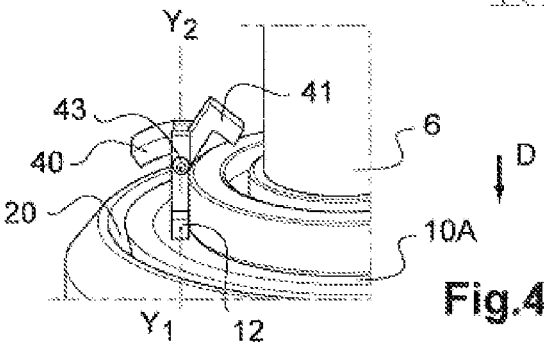

The descent of the holding member 6 continues, which causes the actuating lever 44 to be lodged in its neutral position in the notch 11 and simultaneously causes the complete release of the locking hook 40 from the groove 20 of the exterior tube 2, i.e. in an unlocking position (FIG. 4E). The unlocking of the interior tube 1 from the exterior tube is effectively achieved. In this position, the holding hook 41 begins to pivot toward the groove 60 of the holding member 6 under its own weight and because of the action of the torsion spring 5 which urges said hook 41 toward the interior of the tubes 1, 2.

The descent of the holding member is then interrupted at the end of the stroke A, the holding hook 41 continuing to pivot toward the interior of the tube 1 toward its holding position (FIG. 4F).

Raising of the holding member 6 can then begin, the pivoting of the holding hook 41 continuing until it has penetrated into the groove 60 of the holding member 6, i.e. has reached its holding position (FIG. 4G). The holding and locking of the interior tube 1 to the holding member 6 are then effectively achieved and the unlocking of the interior tube 1 relative to the exterior tube 2 is also achieved. Accordingly, when holding the interior tube, the operative is protected against the risks of damaging the holding system, the interior tube itself or the connection between them. This point is particularly important if the operations are carried out blind or remotely, for example through an opaque cover or slab, as will be the case in the Jules Horowitz irradiation reactor. The control of the two strokes A and B, for example by an automatic mechanism, ensures the safety of these operations.

The raising of the holding member 6 is then continued (FIGS. 4H to 4J). The holding member and the attachment device(s) 4 are sized to overcome the friction forces of the seal(s) 8 accommodated in grooves 80 at the periphery of the interior tube 1 on extraction of the latter from the exterior tube 2 (FIG. 4J).

There will now be described the kinematics of the sealed locking of the interior tube 1 in the exterior tube 2 and, in the same movement of the holding member 6, the release of the interior tube 1 from the latter that the configuration of the system in accordance with the patent application U.S. Pat. No. 9,449,722 allows.

Figure 5A:
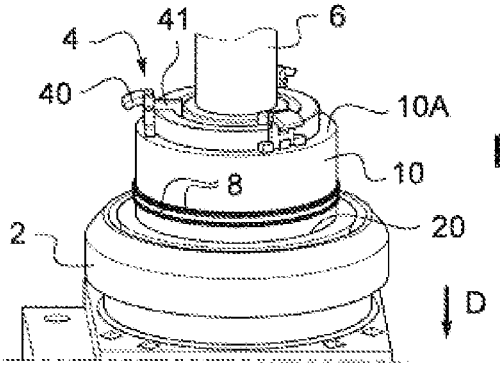
Figure 5B:
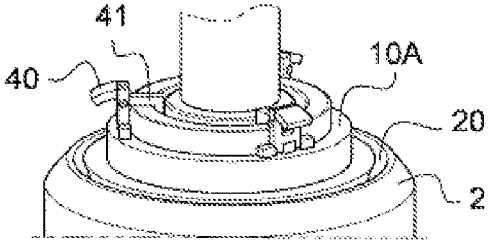
Figure 5C:
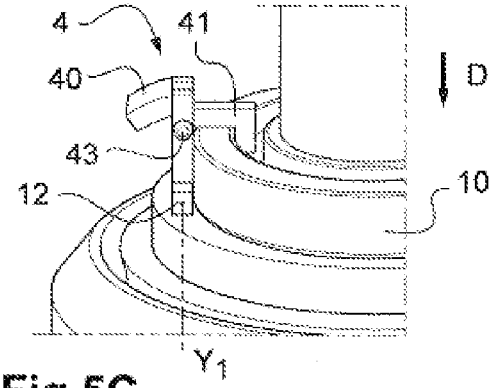

When the interior tube 1 is picked up by the holding member and locked to the latter by the holding hook 41 in its holding position and it is required to lock the interior tube 1 to the exterior tube 2, the holding member 6 is lowered (FIGS. 5A and 5B). The holding member 6 and the attachment device(s) 4 are sized to overcome the friction forces of the seal(s) 8 accommodated in grooves 80 at the periphery of the interior tube 1 on introduction of the latter into the exterior tube 2 (FIG. 5A).

Figure 5D:
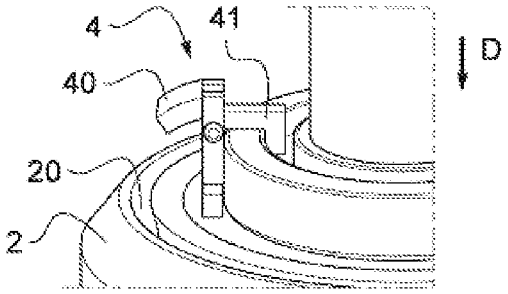
Figure 5E:
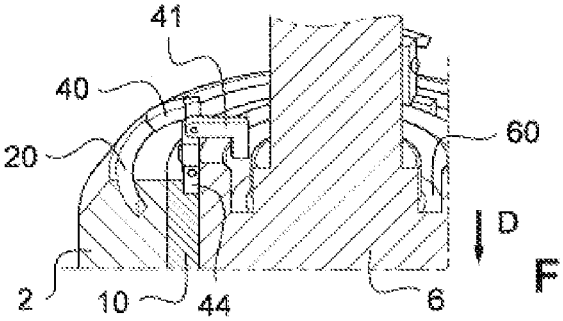

Once introduction of the interior tube 1 into the exterior tube 2 has begun, the descent of the holding member 6 continues (FIG. 5C) until it comes into abutting relationship toward the bottom of the interior tube 1 (FIG. 5D). In this position, the upper end 10*a* of the interior tube 1 is at the level of that of the exterior tube 2.

The descent of the holding member is continued, which causes the release of the holding hook 41 from the groove 60 of the holding member 6 (FIG. 5 E).

The descent of the holding member 6 is continued until the stroke B greater than the stroke A is achieved (FIG. 5F). In this position, the actuating lever 44 is no longer held in its neutral position in the notch 11 by the release member 6.

The locking hook 40 then pivots about the axis Y1 toward the exterior of the tubes 1, 2 under its own weight and because of the action the torsion spring 7, which simultaneously causes pivoting of the actuating lever 44 rotationally coupled to the locking hook 40 and also pivoting of the holding hook 41 to its release position in which it is retained by the torsion spring 5. The pivoting of the locking hook 40 continues until the latter has reached its locking position (FIG. 5G). In this position, the effective locking between the interior tube 1 and the exterior tube 2 is effectively achieved by the locking hook 40.

The holding member 6 is then raised, which causes the actuating lever 44 to pivot upward from its actuating position (FIG. 5G) towards its neutral position (FIG. 5H) in which it does not project inside the interior tube 1 (FIG. 5I).

The raising of the holding member 6 may then continue, the actuating lever 44 pivoting downward under its own weight until it returns to its initial actuating position (FIG. 5I).

To assure on the one hand the conditioning of new and irradiated SH tubes 1 without breaking the required confinement barriers in the reactor pool and on the other hand the holding of an SH tube and its locking/unlocking to/from an IH tube 2 with precise long-term control of the strokes A and B, the invention provides a hood 8 that is described next with reference to FIGS. 6 to 9B.

The handling and conditioning hood 8 in accordance with the invention includes first of all an external enclosure 80 that extends along a longitudinal axis X', including a cover 800, a bottom 801 provided with an opening 802 and a valve 803 for blocking the opening and thereby sealing the external enclosure.

Figure 9:
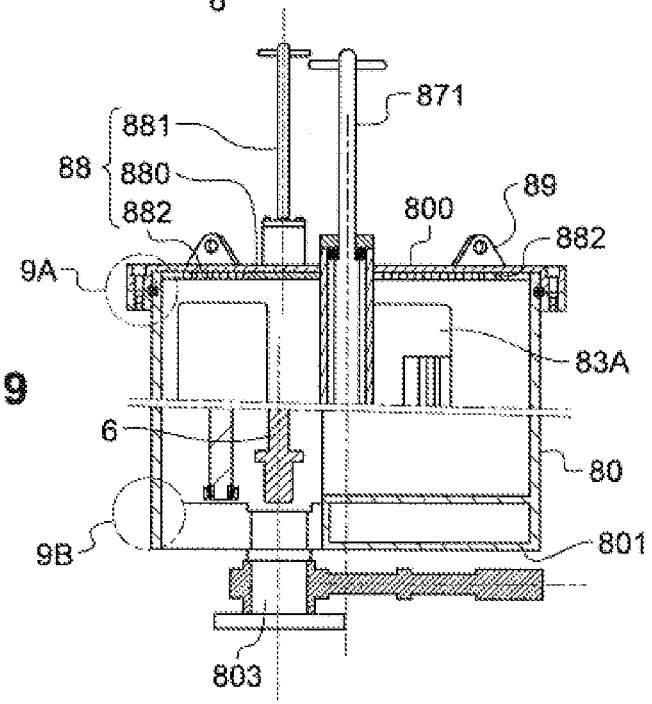
FIG. 9 is a partial perspective view in longitudinal section of the hood from FIG. 6.
Figure 9A:
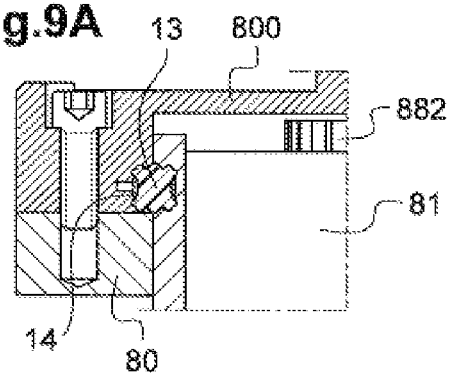
FIGS. 9A and 9B are detail views of FIG. 9.
Figure 9B:
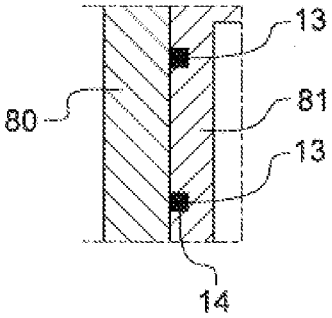

Inside the external enclosure 80 a second enclosure 81 forming a barrel also extending along the axis X' is guided in rotation about this axis X'. In order to prevent water from the reactor pool penetrating into the space between the external enclosure 80 and the barrel 81, two O-rings 13 are advantageously provided, each accommodated at least in part in a peripheral groove 14 respectively at the top and at the bottom of the external wall of the barrel 81, as shown better in the detail FIGS. 9A and 9B.

Each of the three identical internal enclosures 82A, 82B, 82C fastened together extends along a longitudinal axis X1, X2, X3 parallel to the axis X'. They are distributed at 120° from one another inside the barrel 81. Each is adapted to accommodate an SH tube and they are guided in translation in the barrel over a stroke A0. The stroke A0 is very short compared to the stroke A and enables the latter to be completed to achieve the aforementioned stroke B. In other words, the stroke B is equal to the stroke A plus the stroke A0.

Each of these three internal enclosures 82A, 82B, 82C includes within it a holding member 6 with a groove 60 adapted for holding and locking an SH tube as described above with reference to FIGS. 2 to 5J.

Each also includes a screw-nut mechanism 9A, 9B, 9C consisting of a lead screw 90A, 90B, 90C guided in rotation about the axis X1, X2, X3 and a nut 91A, 91B, 91C around the screw and to which the holding member 6 is fastened. The lead screw 90A, 90B, 90C is preferably a screw with a trapezoidal thread.

Figure 8:
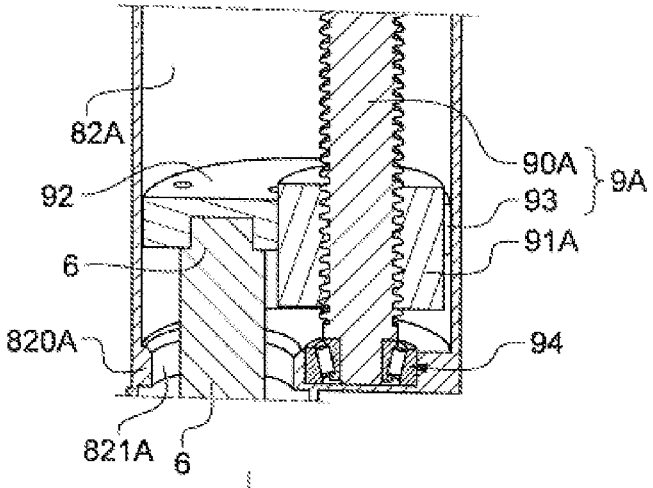
FIG. 8 is a view in partial longitudinal section of an internal enclosure of the hood from FIG. 6.

As FIG. 8 shows more clearly, in accordance with one advantageous assembly variant, the holding member 6 is mounted on the nut 91A, 91B, 91C of the screw-nut mechanism 9A, 9B, 9C by means of a plate 92 guided against the internal wall of the internal enclosure by at least two lugs 93 projecting from the plate and forming centring devices. The rotation of the lead screw 90A, 90B, 90C relative to the corresponding internal enclosure 82A, 82B, 82C is guided by bearing systems 94 on either side of the screw. The types of bearing are of course adapted as a function notably of the length of the lead screw 90A, 90B, 90C and the load to be supported.

Such a screw/nut mechanism is adapted to guide the holding member 6 in translation in the internal enclosure 82A, 82B, 82C along the stroke A, i.e. over all the length of the internal enclosure. For an SH tube length of the order of 3.5 m, the stroke A is typically equal to this length of 3.5 m and the stroke A0 to be reached to effect the stroke B for unlocking the SH tube 1 from the holding member 6 (FIGS. 5F and 5G) is of the order 7.5 to 10 mm.

Finally, as shown more clearly in FIG. 8 in relation to the internal enclosure 82A, each internal enclosure 82A includes a bottom 820A provided with an opening 821A facing the holding member 6 to allow a picked up SH tube 1 to pass through.

To rotate the screw 90A, 90B, 90C of each screw-nut mechanism 9A, 9B, 9C, an electric motor 83A, 83B, 83C is fixed above each internal enclosure 82A, 82B, 82C and inside the barrel 81. This therefore moves the above screwed nut 91A, 91B, 91C over the stroke A. The coupling between a lead screw 90A, 90B, 90C and the output shaft of a corresponding motor 82A, 82B, 82C may be advantageously provided by keys and gripping jaws, not shown, designed for transmission shafts.

The hood 8 further includes mechanical control means 84 arranged in part above the cover 800 of the external enclosure 80 to guide manually in translation the internal enclosures 82A, 82B, 82C over the stroke A0. In the embodiment shown in FIGS. 6 to 9B, these means include a screw-nut mechanism 87 consisting of a lead screw 870 on a portion of a rod 871 guided in rotation about the axis X' and passing through the cover 800 and a nut 872 around the screw and to which the internal enclosures 82A, 82B, 82C are fastened.

Thus according to the invention a double control system is provided offering precise long-term control that consists in:

lowering the holding member over the greatest stroke A by means of a screw-nut mechanism 9A, 9B, 9C actuated in rotation by a motor 83A, 83B, 83C accommodated between the internal enclosure 82A, 82B, 82C on which it is mounted and the cover 800 of the external enclosure 80;

lowering the holding member 6 to unlock a tube 1 between the stroke A and the slightly greater stroke B by means of a screw-nut mechanism 87 actuated manually in rotation by a rod 870 from outside the reactor pool.

The hood 8 also includes mechanical control means 85 arranged in part above the cover 800 of the external enclosure 80 for pivoting the barrel 81 manually in order to bring a holding member 6 of one of the internal enclosures 82A, 82B, 82C opposite the opening 802 in the bottom 801 of the external enclosure 80. In the embodiment shown in FIGS. 6 to 9B, these means 85 include a gear mechanism 88 consisting of a gear 880 on a portion of a rod 881 guided in rotation parallel to the axis X' and passing through the cover 800 and a toothed ring 882 meshing internally with the gear 880 and to which the barrel 81 is fastened. In other words, a compact mechanism usually called a turntable is obtained at the top of the barrel 81.

At the bottom of the opening 821A, 821B, 821C of each internal enclosure 82A, 82B, 82C there is arranged between the latter and the external enclosure 80 a metal bellows 86A, 86B, 86C that provides the seal during movement in translation of the internal enclosures by the screw-nut mechanism 87 over the stroke A0.

In order to be able to move the hood 8 in accordance with the invention in the reactor pool and extract it therefrom, lugs 89 welded to the cover 80 and referred to as slinging lugs are advantageously provided: it is therefore possible to attach to its slings that enable introduction and movement within or extraction from the pool.

Thus the hood 8 in accordance with the invention that has just been described enables execution of operations of handling and confining an irradiated SH tube and its replacement by a new SH tube precisely and with no risk of breaking the confinement barriers. This is all the more advantageous when the operations are carried out blind, for example through a slab or an opaque cover, as will be the case in the Jules Horowitz irradiation reactor. The control of the two strokes A and B by the precise long-term double control of the hood 8 makes it possible to ensure that these operations are safe.

Although described with reference to handling and confinement of SH tubes, the hood 8 that has just been described can serve to handle any object of slender shape in environments that offer little available space and in which safety constraints are very strict, in particular nuclear environments.

The invention is not limited to the examples that have just been described; features of the examples shown may notably be combined with each other in variants that are not shown.

The invention claimed is:

1. A hood for confinement and handling of at least two nuclear material sample tubes comprising:

an external first enclosure extending along a longitudinal axis X', comprising a cover, a bottom provided with an opening and a valve for blocking the opening and thereby sealing the external enclosure;

a second enclosure forming a barrel, extending along the axis X' and guided in rotation about the axis X' inside the external enclosure; and at least one internal third enclosure and one internal fourth enclosure each extending along a longitudinal axis X1, X2 parallel to the axis X' and each adapted to accommodate a nuclear material sample tube, the at least two internal enclosures being fastened to each other and guided in translation in the barrel over a stroke A0;

each internal enclosure comprising within it:

a holding member adapted to pick up a nuclear material sample tube;

a screw-nut mechanism comprising a lead screw guided in rotation about the axis X1, X2 and a nut around the screw and to which the holding member is fastened, the mechanism being adapted to guide the latter in translation in the internal enclosure over a stroke A greater than the stroke A0; and a bottom comprising an opening opposite the holding member to allow one of the nuclear material sample tubes picked up thereby to pass through;

the hood further comprising:

at least one motor fixed above at least one of the said internal enclosures and inside the barrel, the at least one motor being adapted to rotate the screw of the screw-nut mechanism of each internal enclosure and therefore the nut over the stroke A;

a mechanical control arranged in part above the cover of the external enclosure for manually guiding the internal enclosures in translation over the stroke A0; and a mechanical control arranged in part above the cover of the external enclosure for manually pivoting the barrel in order to bring a holding member of one of the internal enclosures opposite the opening in the bottom of the external enclosure.

2. The confinement and handling hood of claim 1, further comprising an internal fifth enclosure also extending along a longitudinal axis X3 parallel to the axis X' and adapted to accommodate a nuclear material sample tube, the three internal enclosures fastened to one another being distributed at 120° to one another inside the barrel.

3. The confinement and handling hood of claim 1, wherein the valve for blocking the opening in the bottom of the external enclosure is further defined as a guillotine valve.

4. The confinement and handling hood of claim 1, further comprising a metal bellows fixed under each opening of an internal enclosure to provide a seal between the latter and the opening of the external enclosure on translation of the internal enclosures in the barrel.

5. The confinement and handling hood of claim 1, further comprising at least two O-rings, each accommodated at least partly in a respective peripheral groove at the top and at the bottom of an external wall of the barrel to provide a seal between the latter and the external enclosure.

6. The confinement and handling hood of claim 1, further comprising a motor fixed above each of the internal enclosures and inside the barrel being adapted to rotate the screw of the screw-nut mechanism of said internal enclosure and therefore the nut over the stroke A.

7. The confinement and handling hood of claim 1, wherein the at least one motor is further defined as an electric motor.

8. The confinement and handling hood of claim 1, wherein the holding member is mounted on the nut of the screw-nut mechanism by means of a plate guided against an internal wall of the internal enclosure by at least two lugs projecting from the plate and forming centering devices.

9. The confinement and handling hood of claim 1, wherein the mechanical control for manually guiding the internal enclosures in translation over the stroke A0 is further defined as comprising a screw-nut mechanism comprising a lead screw on a portion of a rod guided in rotation about the axis X and passing through the cover and a nut around the screw and to which the internal enclosures are fastened.

10. The confinement and handling hood of claim 1, wherein the mechanical control for manually pivoting the barrel comprises a gear mechanism consisting of a gear on a portion of a rod guided in rotation parallel to the axis X' and passing through the cover and a toothed ring meshing internally with the gear and to which the barrel is fastened.

11. The confinement and handling hood of claim 1, wherein the holding member comprises a holding head adapted to be accommodated in an interior tube constituting a nuclear material sample tube to be picked up, the interior tube itself being adapted to be inserted in an exterior tube which cannot be held by the holding head.

12. The confinement and handling hood of claim 11, wherein the exterior tube is a measuring instrument holder tube.

13. The confinement and handling hood of claim 12, wherein the measurement instrument holder tube is adapted to accommodate at least one measurement sensor and/or a cooling system.

* * * * *